US005462351A

United States Patent [19]

Royal

[11] Patent Number: 5,462,351

[45] Date of Patent: Oct. 31, 1995

[54] CONDITIONING VESSEL FOR BULK SOLIDS

[75] Inventor: T. Anthony Royal, North Andover, Mass.

[73] Assignee: Jenike & Johanson, Inc., Westford, Mass.

[21] Appl. No.: 262,681

[22] Filed: Jun. 20, 1994

[51] Int. Cl.[6] ..... B01F 13/02

[52] U.S. Cl. ..... 366/101; 366/341; 222/195; 406/137

[58] Field of Search ..... 366/9, 101, 107, 366/341; 406/136, 137; 222/195, 630; 239/654

[56] References Cited

U.S. PATENT DOCUMENTS

| | | | |
|---|---|---|---|
| 2,884,230 | 4/1959 | Pyle et al. | 222/195 X |
| 3,047,275 | 7/1962 | Cox | 366/101 |
| 3,148,865 | 9/1964 | McClellan | 366/106 |
| 3,166,222 | 1/1965 | Schrader | 222/195 |
| 3,797,707 | 3/1974 | Jenike et al. | 222/193 |
| 3,871,626 | 3/1975 | Wohlfarth | 366/107 |
| 4,286,883 | 9/1981 | Johanson | 366/137 |
| 4,358,207 | 11/1982 | Roth | 366/341 X |
| 4,548,342 | 10/1985 | Fisher | 222/145 |
| 4,809,886 | 3/1989 | Dirkse et al. | 222/195 |
| 4,883,390 | 11/1989 | Reintjes et al. | 406/24 |
| 4,923,304 | 5/1990 | Jackson et al. | 366/336 X |
| 4,941,779 | 7/1990 | Dewitz et al. | 406/137 X |
| 5,129,766 | 7/1992 | Dirkse et al. | 406/136 |
| 5,181,633 | 1/1993 | Weber et al. | 222/195 |
| 5,277,492 | 1/1994 | Paul | 366/341 X |

FOREIGN PATENT DOCUMENTS

| | | | |
|---|---|---|---|
| 1147756 | 3/1960 | Germany . | |
| 4631323 | 9/1971 | Japan | 366/101 |
| 96013 | 3/1960 | Norway . | |
| 2174372 | 11/1986 | United Kingdom . | |

*Primary Examiner*—Charles E. Cooley
*Attorney, Agent, or Firm*—Lahive & Cockfield

[57] ABSTRACT

A gas conditioning vessel for bulk solids undergoing mass flow. The gas is introduced into the solids through an open bottom distributor forming a plenum. The plenum opens into the vessel at its bottom, the injection sites being bounded by vertical walls of the distributor. The vertical configuration optimizes solids pressure at these sites to suppress localized fluidization and flow instability due to stress conditions.

7 Claims, 4 Drawing Sheets

CONDITIONING VESSEL FOR BULK SOLIDS

SUMMARY OF THE INVENTION

This invention relates generally to apparatus for conditioning bulk solids by injection of a gas. The purpose of such injection may be heating, drying, purging the solids of a fluid or fluids, causing or stopping a chemical reaction, and/or increasing the rate of solids discharge. More specifically, the invention concerns apparatus for achieving greater uniformity of exposure of the bulk solids to the injected gas while the solids are flowing through the vessel under mass flow conditions.

Bulk solids for such gas conditioning may take a variety of solid particulate forms, either granular or pulverulent. The process vessels ordinarily comprise bins having cylindrical or rectangular shaped vertical sided sections joined at their lower ends with hopper sections terminating in discharge openings, feeders or gates. Problems with the flow behavior of bulk solids in such vessels that are static, i.e. not equipped with movable flow aids, and that are not equipped for gas injection, have been the subject of intensive study. Among these problems are bridging of the solids above the discharge opening, ratholing, creation of regions within the vessel where the solids do not move toward the discharge opening, and segregation of mixed particles that differ in physical or flow properties. As stated in the U.S. patent to Johanson U.S. Pat. No. 4,286,883 dated Sep. 1, 1981, an optimum flow condition termed "mass flow" has been defined as that condition in which all of the solid material within the bin is in motion whenever any of it is drawn out.

A basic condition for mass flow, as stated in the above patent, is that the hopper wall must have an angle measured from the vertical that does not exceed a predetermined "mass flow angle." If this condition is met, the solids in contact with the hopper wall surface will be in motion whenever solids are withdrawn from the hopper.

In the past, various efforts have been made to introduce gas into bulk solids within vessels that fail to satisfy, the above condition for mass flow. The structures employed for gas injection have also taken various forms that tend to create nonuniform exposure of the solids to gas, flow instability such as fluidization in localized regions, erratic flow and pockets where the solids are not in motion. As a result, such gas conditioning apparatus is not suited for industrial processing that is heavily dependent on uniformity of solids flow rates from the vessel as well as uniform exposure of the solids to the conditioning gas.

With a view to overcoming the foregoing problems, this invention has for its principal object the provision of a gas distributor for use in a conditioning vessel having walls structured to satisfy the conditions for mass flow.

A second object is to provide forms of gas distributors adapted for injection of gas into bulk solids moving under mass flow with minimal disturbance of such flow.

A further object is to achieve the foregoing results by means of gas distributors configured for uniformity of exposure of the moving solids to the conditioning gas.

With the foregoing and other objects hereinafter appearing in view, a principal feature of this invention is the introduction of the gas through a plenum or plenums constructed to maximize the solids pressure in the localized regions of gas injection, thereby preventing fluidization in such regions and preventing the creation of flow instability due to stress conditions at any point within the conditioning vessel.

For the achievement of such purposes, a structural feature of the invention resides in the provision of a plenum or plenums having vertical sides or walls at their lower ends, such lower ends or openings comprising the principal means by which gas is injected into the vessel.

A further feature of the invention is that the improved gas distributors can be located within the hopper section of the conditioning vessel and/or within the vertical sided or cylinder section above it, at any desired level or levels of either section.

The gas distributor may comprise a ring located adjacent the inner wall of the conditioning vessel and defining an annular plenum space, or one or more interior rings, or one or more crossbeams defining plenums, or a combination of a ring or rings and one or more crossbeams.

The structures of the invention may have any of a number of possible connections to a source of gas, as hereinafter described.

DETAILED DESCRIPTION

Figure 1:
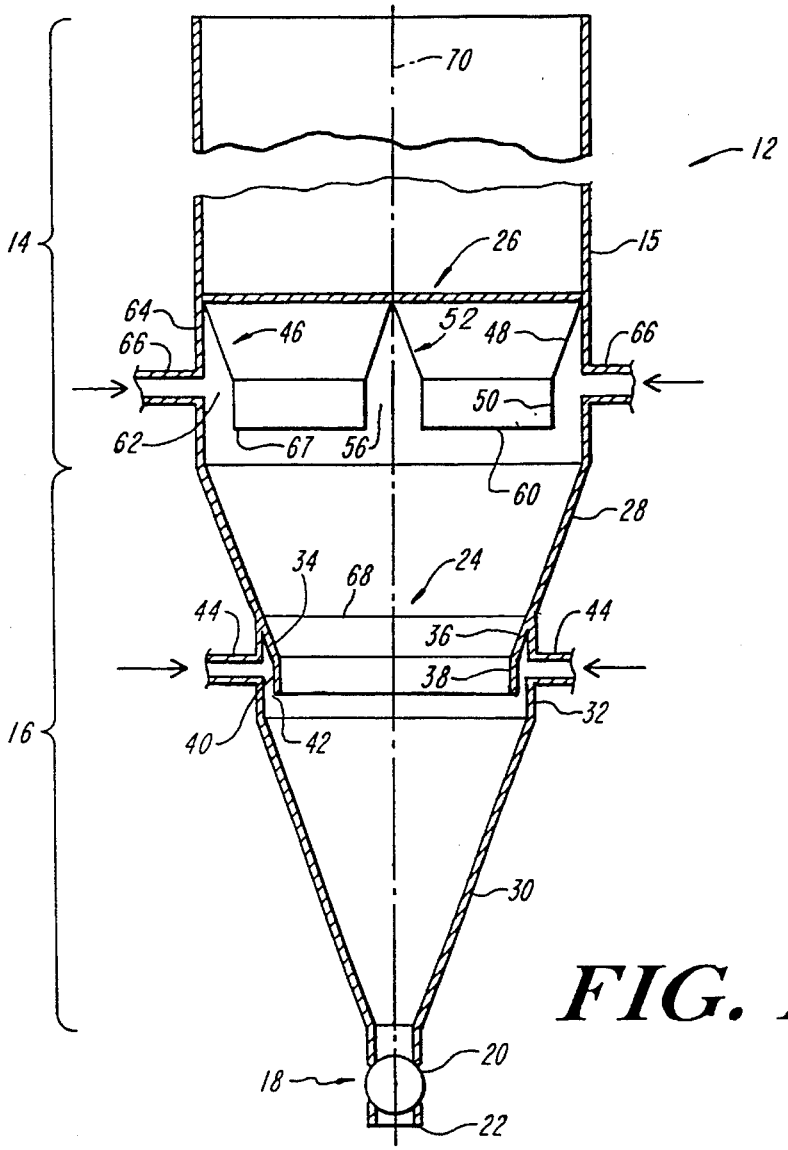
FIG. 1 is an elevation in section taken on line 1—1 of FIG. 2, of a first embodiment of a conditioning vessel equipped with first and second embodiments of gas distributors according to the invention.
Figure 2:
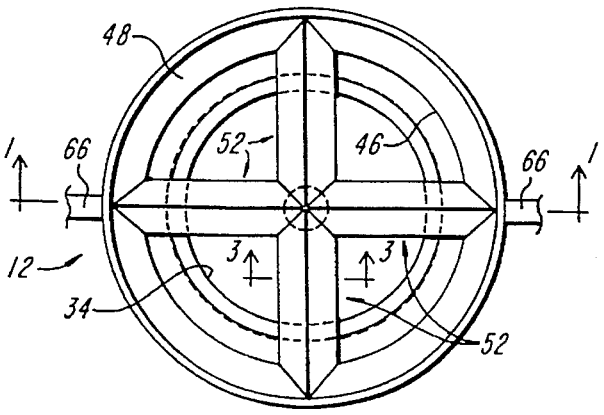
FIG. 2 is a view in plan corresponding to FIG. 1.
Figure 3:
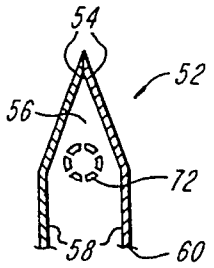
FIG. 3 is an elevation in section taken on line 3—3 of FIG. 2, also showing a perforated gas distribution pipe comprising an alternative means for distributing the gas into the plenum spaces.

Referring to FIGS. 1 to 3, a gas conditioning vessel for bulk solids according to this invention is a bin shown generally at 12. In accordance with conventional construction, the vessel comprises a section 14 having a vertical wall 15, in this case of cylindrical form, a hopper section 16 and discharge means 18, shown for example as a valve 20 that may be closed, opened or partially opened to discharge the solids from a discharge opening 22. Alternatively, the valve 20 may be replaced by a suitable feeder. In this embodiment both the hopper section 16 and the cylinder section 14 are circular in horizontal cross section throughout their vertical height. Alternatively, in accordance with conventional practice, the hopper section 16 may be of pyramidal or other configuration and the cylinder section 14 may have a square, rectangular or other horizontal cross section. As used herein, the terms "cylinder" and "cylinder section" with reference to the section 14 are intended to include any structure having a constant horizontal cross sectional area. For any configuration of the bin the gas distributor structure hereinafter described has a corresponding shape to conform to the inner walls of the bin.

The bin 12 of FIG. 1 is shown equipped with two embodiments of gas distributors 24 and 26 according to the invention, the distributor 24 being located at a selected height within the hopper section 16 and the distributor 26 being located at a selected height within the cylinder section 14.

The hopper section 16 comprises conical walls 28 and 30 separated by a cylindrical wall 32 surrounding the distributor 24. Each of the walls 28 and 30 has a slope forming an angle with the vertical that is less than the mass flow angle of the bulk solids to be contained within the vessel and to be conditioned with gas. Thus the bin 12 inherently satisfies the conditions for mass flow.

The gas distributor 24 comprises a ring 34 preferably formed of sheet metal and having a closed, inverted and truncated conical portion 36 and a closed vertical cylindrical portion 38 connected annularly to the lower end of the portion 36. The portions 36 and 38 may be perforated or imperforate, although they are preferably imperforate. The upper end of the portion 36 is in annular engagement with the wall of the section 32, and is sloped downwardly and inwardly thereof to form an annular plenum space 40. The space 40 opens into the vessel 12 at its lower gas injection end defined by an annular edge 42.

Pipes 44 are connected through the wall of the section 32 to the plenum space 40, and extend externally of the vessel 12 to a source of gas under pressure (not shown).

The gas distributor 26 comprises a ring 46 similar in construction to the ring 34, including a sloping portion 48 of the same form and configuration as the portion 36, and a vertical cylindrical portion 50 similar in configuration to the portion 38. In addition, the distributor 26 comprises four mutually intersecting crossbeams 52, each having a vertical cross section as shown in FIG. 3, and extending horizontally on a chord, in this case a diameter, of the wall 15. Each crossbeam comprises a pair of sloping sides 54 connected at their upper edges and sloping downwardly in opposite directions to form a plenum space 56 therebetween. A pair of flat vertical sides 58 are connected to the respective lower edges of the sloping sides 54 to extend the plenum space 56 and to define a lower gas injection end defined by edges 60 thereof opening into the vessel 12. The sides 54 and 58 may have perforations but they are preferably imperforate as shown.

One end of each crossbeam intersects with the ring 46, with the respective sloping and vertical sides of the ring and crossbeam joined so that the plenum spaces 56 of the cross beams communicate with the annular plenum space 62. The crossbeams also intersect with one another so that their respective plenum spaces are in mutual gas conductive communication. Pipes 66 are connected between the plenum 62 and an external source of gas under pressure. By this means all of the plenum spaces are filled with gas and the gas is injected into the solids at the lower ends or edges 60 of the crossbeams and corresponding edges 67 of the vertical portions 50 of the ring 46.

As previously stated, the conditioning vessel 12 is constructed to permit mass flow of solids when the valve 20 is opened, whether or not gas is introduced into the plenums 40, 56 and 62 through the pipes 44 and 66. The gas distributors 24 and 26 are so constructed that the introduction of gas into the plenums causes a more uniform distribution thereof into the solids without disturbing this mass flow. By introducing the gas through plenums that have vertical sides, solids pressure is applied at and externally of the bottom edges 42, 60 and 67, and this pressure at the regions where the gas is being introduced minimizes the possibility of localized fluidization.

To increase the uniformity of gas distribution into the solids, the ring of the gas distributor is combined with crossbeams 52, of which four are shown in the embodiment 26. A greater or lesser number of crossbeams may be provided, each preferably located on a diameter of the ring when the latter has a circular configuration as shown. By varying the size and the number of crossbeams, which are configured like the spokes of a wheel, it is possible to vary the cross-sectional area over which the gas is being introduced. This directly affects the uniformity of gas distribution within the solids.

FIG. 1 illustrates a vessel which has been modified to introduce gas into the solids at a selected level within the hopper section 16. A conical hopper has been cut at a horizontal plane 68 to permit the addition of the cylindrical section 32 as shown. The vertical side of this section, in combination with the sloping portion 36 and vertical portion 38 of the distributor 24, defines the annular plenum space 40. If desired, crossbeams may be added to the ring as described.

The distributor 26, when installed in the cylinder section 14, can be located at any position along the vertical axis 70 of the bin.

As described above, the conditioning gas is confined only by the inner walls of the respective plenum spaces. Alternatively, as shown in FIG. 3, gas conducting tubing or pipes 72 may extend within and throughout the system of intercommunicating plenums. The tubing or pipes may be perforated, in which case the sizes and distribution of the perforations at various locations may be varied so that, in conjunction with the gas pressure within the tubing or pipes, a uniform rate of delivery of gas is achieved throughout the cross section of the vessel.

Figure 4:
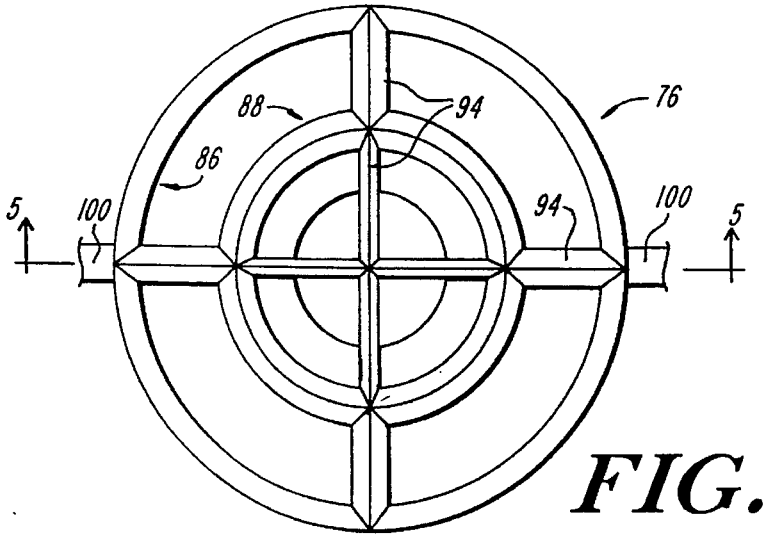
FIG. 4 is a view in plan of a second embodiment of a conditioning vessel having an inner cone for achieving mass flow.
Figure 5:
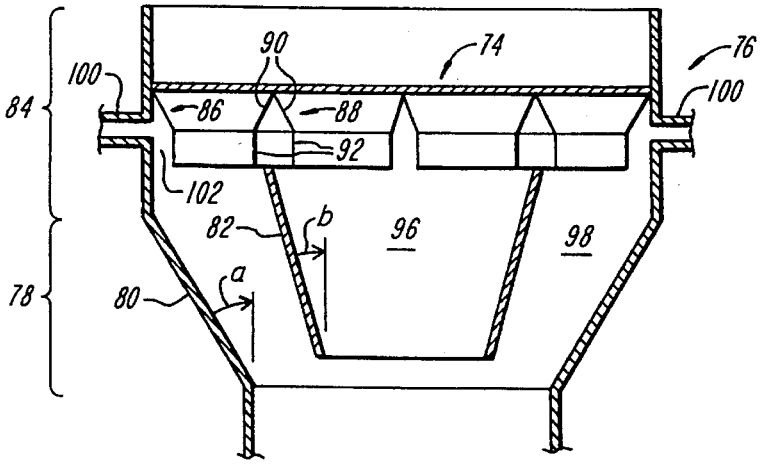
FIG. 5 is an elevation in section taken on line 5—5 of FIG. 4.

FIGS. 4 and 5 illustrate the installation of a gas distributor 74 in a bin 76 having a hopper section 78 comprising a conical wall 80 that does not satisfy the conditions for mass flow. Thus the wall 80 forms an angle "a" with the vertical that is greater than the critical mass flow angle for the solids to be conditioned with gas. In this embodiment a truncated inverted conical insert 82 is supported within the bin 76 in accordance with the above-mentioned U.S. Pat. No. 4,286,883. The interior surface of the wall of the insert 82 has an angle "b" with the vertical that is less than the critical mass flow angle for the solids, and the angle (a-b) formed between the wall 80 and the insert 82 is also less than the critical mass flow angle. With the insert as shown, the bin 76 satisfies the conditions for mass flow.

The gas distributor 74 of FIGS. 4 and 5 is mounted directly above the insert 82 in the cylinder section 84 of the bin. This embodiment is provided with an outer ring 86 of the same form as the rings 34 and 46 of FIG. 1, and an inner ring 88 similar in construction to the crossbeams 52 of FIGS. 2 and 3 except that its sloping walls 90 and vertical walls 92 are of circular configuration in plan view. The outer and inner rings 86 and 88 are intersected by a plurality of crossbeams 94 of the form described in connection with

FIG. 3.

The insert 82 may be supported by the gas distributor assembly 74, or may be supported by suitable brackets (not shown) extending to the cylinder section 84.

In the embodiment of FIGS. 4 and 5 gas is injected into the stream of solids flowing through both the space 96 within the insert 82 and the annular space 98 surrounding the insert.

Figure 6:
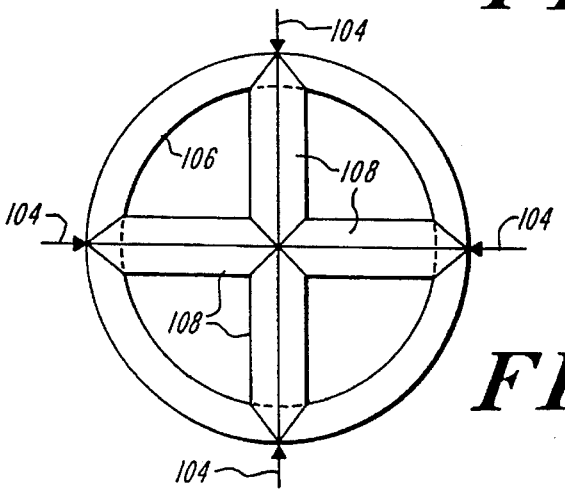
FIG. 6 is a partially schematic view in plan showing a first alternative form of connection to a source of gas.

As noted above, connections to an external source of gas under pressure may take any of several forms. In the embodiment of FIGS. 4 and 5 pipes 100 connect through the wall of the cylinder section 84 into diametrically opposed points in the annular plenum 102, as in the embodiments of FIGS. 1 to 3. FIG. 6 schematically shows an alternative arrangement having four pipes 104 similarly connecting into the annular plenum at the points of juncture of a ring 106 and crossbeams 108.

Figure 7:
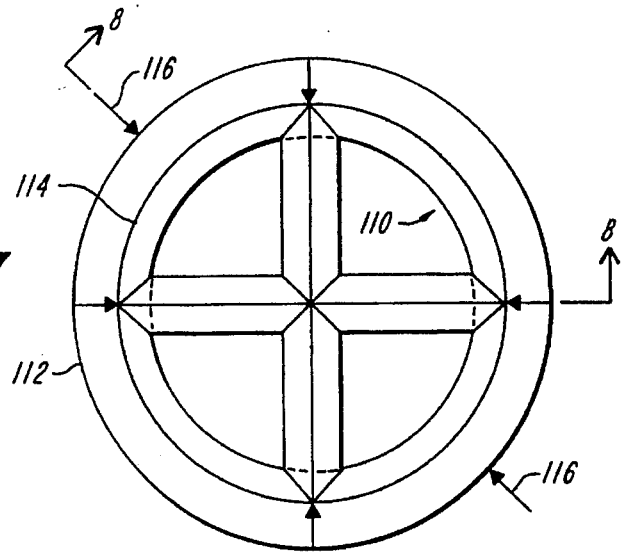
FIG. 7 is a partially schematic view in plan showing a second alternative form of connection to a source of gas.
Figure 8:
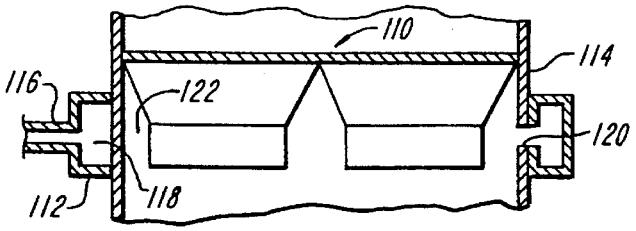
FIG. 8 is a fragmentary elevation in section taken on line 8—8 of FIG. 7.

The embodiment of FIGS. 7 and 8 includes a gas distributor 110 similar to the distributor 26 of FIGS. 1 to 3. A bustle pipe 112 surrounds and is welded to the cylinder section 114 of the bin. In this embodiment the bustle pipe is of circular form in plan view and has a rectangular cross section, although cross sections of circular, square or other shapes can be employed. Diametrically opposed pipes 116 connect the interior space 118 of the bustle pipe to a source of gas under pressure. Four inlet openings 120 connect from the interior of the bustle pipe to the annular plenum space 122 at the positions illustrated diagrammatically in FIG. 7.

Figure 9:
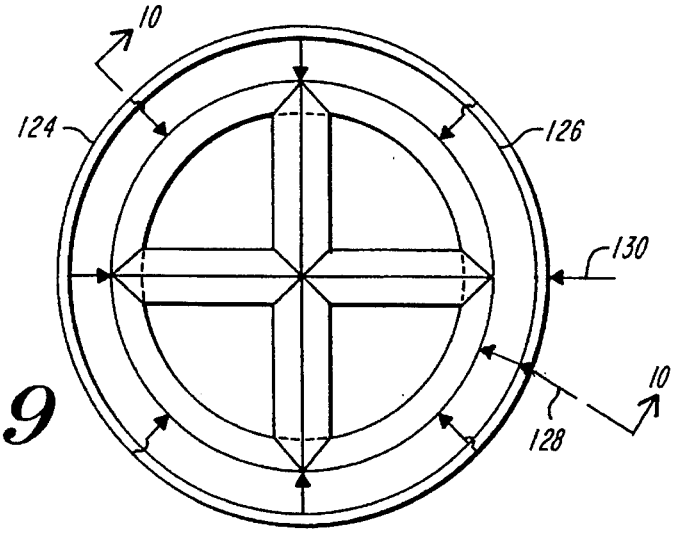
FIG. 9 is a partially schematic view in plan showing a third alternative form of connection to a source of gas.
Figure 10:
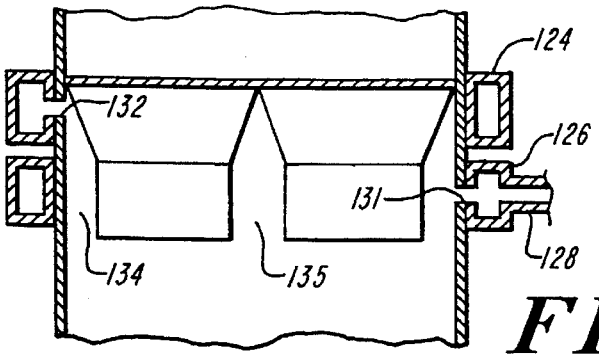
FIG. 10 is a fragmentary elevation in section taken on line 10—10 of FIG. 9.

The embodiment of FIGS. 9 and 10 employs two bustle pipes 124 and 126. A single pipe 128 connects the bustle pipe 126 to a source of gas under pressure, and a pipe 130 similarly supplies gas to the bustle pipe 124. The inlets 131 and 132 respectively communicating between the bustle pipes 126 and 124 and the annular plenum space 134 are uniformly distributed around the circumference of the latter space as shown in FIG. 9.

An alternative embodiment is similar to that of FIGS. 9 and 10 except that the plenum space 134 has a gas supply separate from the plenum spaces 135. This is accomplished by closing off the gas communication between the plenum spaces defined by the ring and crossbeams, connecting the bustle pipe 124 to communicate only with the plenum space 134 and connecting the bustle pipe 126 to communicate only with the plenum space 135.

In the embodiments employing bustle pipes, it will be noted that the cross sectional area of these pipes is substantially greater than the areas of the inlets 120, 130 and 132 connecting into the plenum spaces. The restricted gas flow through these inlets therefore allows the air to circulate through the bustle pipe to other inlets, thus providing a simple means of achieving relatively uniform gas flows through each aperture.

Figure 11:
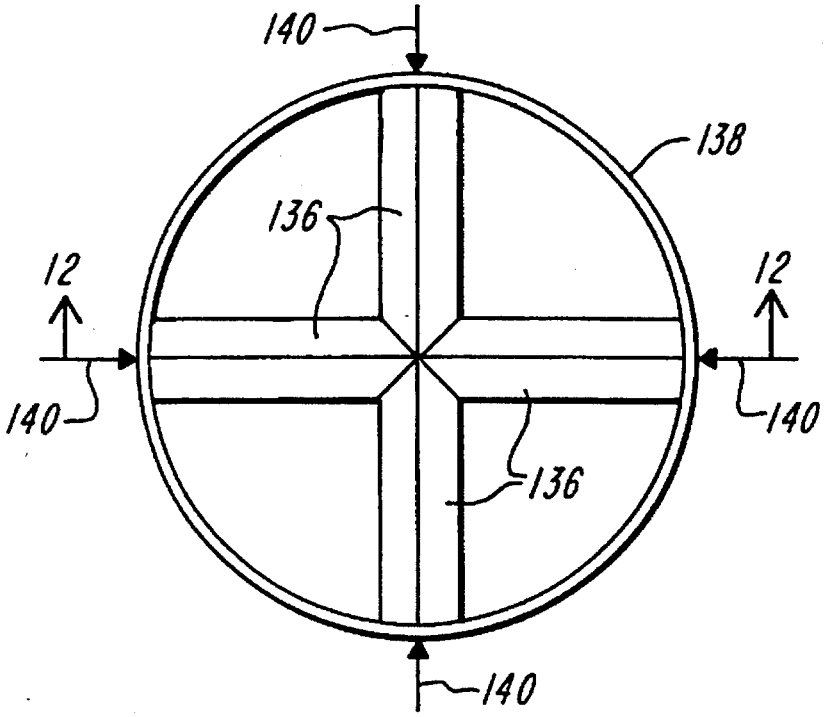
FIG. 11 is a view in plan of a gas conditioning vessel equipped with another embodiment of gas distributor.
Figure 12:
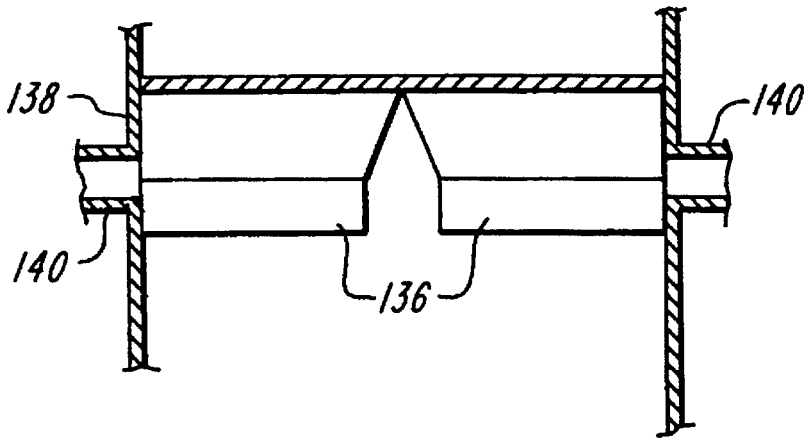
FIG. 12 is a fragmentary elevation in section taken on line 12—12 of FIG. 11.

FIGS. 11 and 12 illustrate another embodiment of gas distributor having crossbeams 136 extending on diameters of a cylindrical bin section 138. The construction of these crossbeams is similar to that shown in FIGS. 1 to 3 except that the annular ring of the gas distributor is eliminated. Four pipes 140 connect through the wall of the cylinder section 138 to the ends of the plenum spaces defined by the crossbeams.

I claim:

1. A conditioning vessel for bulk solids comprising, in combination, a bin comprising an annular first wall of generally constant cross section in the vertical dimension and an annular second wall joined to the lower end of the first wall and sloping downwardly and inwardly toward a discharge end, said bin being adapted to satisfy the conditions for mass flow of the solids, a gas distributor comprising at least one elongate crossbeam extending on a chord within the interior of said first wall and comprising horizontally extending elongate sloping portions and elongate vertical portions joined to the lower ends of the sloping portions, said sloping and vertical portions forming a plenum space open to the interior of the bin at the lower ends of said vertical portions, and means to connect said plenum space to a source of gas under pressure.

2. The combination of claim 1, in which the gas distributor comprises a plurality of elongate crossbeams each extending on a chord within the interior of said first wall and defining a plenum space intersecting and in gas conductive communication with the plenum spaces of the other crossbeams.

3. A conditioning vessel for bulk solids comprising, in combination, a bin comprising an annular first wall of generally constant cross section in the vertical dimension and an annular second wall joined to the lower end of the first wall and sloping downwardly and inwardly toward a discharge end, said bin being adapted to satisfy the conditions for mass flow of the solids, a gas distributor comprising a ring having an elongate sloping portion extending horizontally within the interior of said first wall and sloping downwardly and inwardly relative thereto, and at least one crossbeam extending on a chord within the interior of said first wall and comprising horizontally extending elongate sloping portions, the sloping portion of said ring having an elongate vertical portion joined to the lower end thereof to form a plenum space open to the interior of the bin at the lower end of said vertical portion of said ring, the sloping portions of said at least one crossbeam each having an elongate vertical portion joined to the lower ends thereof to form a plenum space open to the interior of the bin at the lower end of said vertical portions of said at least one crossbeam said plenum space formed by said ring being partially bounded by the inner surface of said first wall, and means to connect said plenum spaces to a source of gas under pressure.

4. A conditioning vessel for bulk solids comprising, in combination, a bin comprising an annular first wall of generally constant cross section in the vertical dimension and an annular second wall joined to the lower end of the first wall and sloping downwardly and inwardly toward a discharge end, a gas distributor comprising at least one elongate sloping portion extending horizontally within the interior of said first wall and an elongate vertical portion joined to the lower end of said sloping portion, said sloping and vertical portions forming a plenum space open to the interior of the bin at the lower end of said vertical portion, means to connect said plenum space to a source of gas under pressure, and a closed annular third wall sloping downwardly and inwardly and spaced from and within the second wall, the interior surface of the third wall sloping downwardly and inwardly at an angle to the vertical that is less than the critical mass flow angle of the solids, and the difference between the slopes of the second and third walls being less than said angle.

5. A conditioning vessel for bulk solids comprising, in combination, a bin comprising an annular first wall of generally constant cross section in the vertical dimension and an annular second wall joined to the lower end of the first wall and sloping downwardly and inwardly toward a discharge end, said bin being adapted to satisfy the conditions for mass flow of the solids, a gas distributor comprising a first ring having an elongate sloping portion extending horizontally within the interior of said first wall and sloping downwardly and inwardly relative thereto, and an elongate vertical portion joined to the lower end of said sloping portion, said sloping and vertical portions forming a first annular plenum space partially bounded by the inner surface of said first wall, a second ring spaced from and within the first ring and having sloping and vertical portions forming a second annular plenum space, said first and second plenum spaces each being open to the interior of the bin at the lower ends of said vertical portions, and at least one crossbeam extending between and in gas conductive communication with said first and second rings, and means to connect said plenum spaces to a source of gas under pressure.

6. The combination of claim 5, including a closed annular third wall sloping downwardly and inwardly and spaced from and within the second wall, the interior surface of the third wall sloping downwardly and inwardly at an angle to the vertical that is less than the critical mass flow angle of the solids, and the difference between the slopes of the second and third walls being less than said angle.

7. A conditioning vessel for bulk solids comprising, in combination, a bin comprising an annular first wall of generally constant cross section in the vertical dimension and an annular second wall joined to the lower end of the first wall and sloping downwardly and inwardly toward a discharge end, said bin being adapted to satisfy the conditions for mass flow of the solids, a gas distributor comprising at least one elongate sloping portion extending horizontally within the interior of said first wall, an elongate vertical portion joined to the lower end of said sloping portion, said sloping and vertical portions forming a plenum space open to the interior of the bin at the lower end of said vertical portion, and a tube perforated along its length and extending along and within the plenum space, and means to connect said tube to a source of gas under pressure.

* * * * *